US010673126B2

(12) United States Patent
Hwang et al.

(10) Patent No.: US 10,673,126 B2
(45) Date of Patent: Jun. 2, 2020

(54) ANTENNA DEVICE FOR PORTABLE TERMINAL

(71) Applicant: Samsung Electronics Co., Ltd., Suwon-si, Gyeonggi-do (KR)

(72) Inventors: Soon-Ho Hwang, Seoul (KR); Sung-Koo Park, Suwon-si (KR); Kyung-Jae Lee, Seoul (KR); Joon-Ho Byun, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/937,017

(22) Filed: Mar. 27, 2018

(65) Prior Publication Data

US 2018/0212312 A1 Jul. 26, 2018

Related U.S. Application Data

(63) Continuation of application No. 15/185,738, filed on Jun. 17, 2016, now Pat. No. 10,211,515, which is a (Continued)

(30) Foreign Application Priority Data

Jan. 30, 2013 (KR) ..... 10-2013-0010477

(51) Int. Cl.
*H01Q 1/24* (2006.01)
*H01Q 13/10* (2006.01)
(Continued)

(52) U.S. Cl.
CPC ..... *H01Q 1/243* (2013.01); *H01Q 1/44* (2013.01); *H01Q 1/48* (2013.01); *H01Q 1/50* (2013.01); *H01Q 13/10* (2013.01)

(58) Field of Classification Search
CPC ..... H01Q 1/24; H01Q 1/241; H01Q 1/242; H01Q 1/243; H01Q 1/44; H01Q 1/48;
(Continued)

(56) References Cited

U.S. PATENT DOCUMENTS 6,630,908 B2 * 10/2003 Gushiken ..... G06F 1/1616 343/702
6,937,196 B2 8/2005 Korva
(Continued)

FOREIGN PATENT DOCUMENTS

CN 102738556 A 10/2012
EP 1 619 749 A1 1/2006
(Continued)

OTHER PUBLICATIONS

Korean Decision on Grant dated Jun. 20, 2019, issued in Korean Patent Application No. 10-2013-0010477.

*Primary Examiner* — Daniel Munoz
*Assistant Examiner* — Patrick R Holecek
(74) *Attorney, Agent, or Firm* — Jefferson IP Law, LLP

(57) ABSTRACT

An antenna device of a portable terminal including conductive components is provided. The antenna device includes a first radiator connected to a power feeding unit of the portable terminal and a second radiator connected to each of the power feeding unit and a ground part of the portable terminal. At least one of the conductive components is connected to at least one the first radiator and the second radiator. The conductive components may be used as a radiator of the antenna device such that the antenna device may be easily installed within an inner space of a miniaturized and lightened portable terminal and the inner space of the portable terminal may be efficiently used.

20 Claims, 6 Drawing Sheets

Related U.S. Application Data continuation of application No. 13/937,725, filed on Jul. 9, 2013, now Pat. No. 9,373,883.

(51) Int. Cl.
*H01Q 1/44* (2006.01)
*H01Q 1/48* (2006.01)
*H01Q 1/50* (2006.01)

(58) Field of Classification Search
CPC ..... H01Q 1/50; H01Q 13/10; H01Q 13/103; H01Q 13/106; H01Q 13/16
See application file for complete search history.

(56) References Cited

U.S. PATENT DOCUMENTS

| | | | | |
|---|---|---|---|---|
| 7,551,142 | B1 | 6/2009 | Zhang et al. | |
| 8,581,799 | B2 | 11/2013 | Choi et al. | |
| 8,606,195 | B2 | 12/2013 | Suetake et al. | |
| 9,166,279 | B2 | 10/2015 | Jin et al. | |
| 9,373,883 | B2 | 6/2016 | Hwang et al. | |
| 9,716,307 | B2 * | 7/2017 | Tsai | H01Q 13/106 |
| 2005/0017909 | A1 | 1/2005 | Carpenter et al. | |
| 2008/0316118 | A1 | 12/2008 | Puente Baliarda et al. | |
| 2009/0073059 | A1 | 3/2009 | Ikegaya | |
| 2010/0001909 | A1 | 1/2010 | Nielsen | |
| 2010/0164835 | A1 | 7/2010 | Tai et al. | |
| 2010/0271264 | A1 | 10/2010 | Li et al. | |
| 2011/0183633 | A1 | 7/2011 | Ohba et al. | |
| 2011/0210898 | A1 | 9/2011 | Choi et al. | |
| 2011/0316751 | A1 | 12/2011 | Jarvis et al. | |
| 2012/0050114 | A1 * | 3/2012 | Li | H01Q 1/2266 343/702 |
| 2012/0229347 | A1 | 9/2012 | Jin et al. | |
| 2012/0262345 | A1 | 10/2012 | Kim et al. | |
| 2013/0050026 | A1 | 2/2013 | Vin et al. | |
| 2013/0207855 | A1 | 8/2013 | Chien et al. | |
| 2016/0301126 | A1 * | 10/2016 | Hwang | H01Q 1/44 |

FOREIGN PATENT DOCUMENTS

| | | | |
|---|---|---|---|
| EP | 1 703 586 | A1 | 9/2006 |
| EP | 2 511 979 | A1 | 10/2012 |
| EP | 2 562 867 | A1 | 2/2013 |
| JP | 2005-210665 | A | 8/2005 |
| JP | 2007-534188 | A | 11/2007 |
| JP | 2012-186811 | A | 9/2012 |
| KR | 10-2013-0020981 | A | 3/2013 |
| WO | 2011/031668 | A1 | 3/2011 |
| WO | 2012/153282 | A1 | 11/2012 |

* cited by examiner

ANTENNA DEVICE FOR PORTABLE TERMINAL

CROSS-REFERENCE TO RELATED APPLICATION(S)

This application is a continuation application of a prior application Ser. No. 15/185,738, filed Jun. 17, 2016, which is a continuation of a prior application Ser. No. 13/937,725, filed on Jul. 9, 2013, which has issued as U.S. Pat. No. 9,373,883 on Jun. 21, 2016 and was based on and claimed priority under 35 U.S.C § 119(a) of a Korean patent application number 10-2013-0010477, filed on Jan. 30, 2013, in the Korean Intellectual Property Office, the disclosure of which is incorporated by reference herein in its entirety.

BACKGROUND OF THE INVENTION

1. Field of the Invention

The present invention relates to a portable terminal. More particularly, the present invention relates to an antenna device that enables wireless communication of a portable terminal.

2. Description of the Related Art

A portable terminal may be a device that allows a user to use a communication function, such as voice communication or short message transmission, a multimedia function, such as playing music or reproducing a moving image, an entertainment function, such as a game while the user is carrying the portable device, or any other similar and/or suitable function that may be executed on a portable terminal or portable electronic device. Such portable terminals are fabricated in various types considering specialized functions and portability thereof. For example, the portable terminals may be classified into a bar-type, a folder-type, a slider type, or any other similar and/or suitable type based on external appearances thereof. As multimedia functions are increased and improved, a large display device may be mounted on portable terminals. In addition, as the degree of integration in electronic devices is increased and high capacity and ultra high speed wireless communication is popularized, various functions are integrated in a single portable terminal, for example, a mobile communication terminal.

As the multimedia services and entertainment functions using a portable terminal are increased and improved, the sizes of display devices are being gradually increased, especially in mobile communication terminals. However, when considering the portability, miniaturization and lightening of portable terminals are needed. Accordingly, in order to provide portability of mobile communication terminals while increasing the size of display devices, a thickness of portable terminals should be reduced.

Portable terminals, such as the mobile communication terminals, are provided with an antenna device for performing wireless communication. The antenna device should be installed to protrude from the portable terminal in order to secure a radiation characteristic and in order to suppress interference with other circuit devices. However, considering the external appearance and portability of such a portable terminal, the antenna device may be installed inside of the terminal. The antenna device, and in particular, a radiation unit pattern, may have a preferable radiation characteristic when a sufficient distance from a main circuit board is secured in the inside of the terminal and interference with other conductive components or integrated circuit chips within the portable terminal is suppressed.

However, the thickness of portable terminals may be reduced in order to miniaturize and lighten the portable terminals as the size of displays is increased, and the ability to provide antenna devices capable of securing a stable radiation performance while being installed inside of portable terminals may be limited. In addition, as a plurality of antenna devices are installed in a single terminal in order to use various types of communication systems and standards, for example, a variety of mobile communication standards, wireless Local Area Network (LAN) standards, Bluetooth, Near Field Communication (NFC), and any other communication systems and standards, difficulties in arranging the antenna devices inside of a portable terminal may increase.

The above information is presented as background information only to assist with an understanding of the present disclosure. No determination has been made, and no assertion is made, as to whether any of the above might be applicable as prior art with regard to the present invention.

SUMMARY OF THE INVENTION

Aspects of the present invention are to address at least the above-mentioned problems and/or disadvantages and to provide at least the advantages described below. Accordingly, an aspect of the present invention is to provide an antenna device that is capable of providing a stable radiation performance while being installed in an internal space of a miniaturized and lightened portable terminal.

Also, another aspect of the present invention is to provide an antenna device that improves a degree of freedom in design within a portable terminal by using conductive components in the interior of the portable terminal as a radiator.

Further, still another aspect of the present invention is to provide an antenna device that improves the efficiency of using the internal space of a portable terminal by using conductive components in the interior of the portable terminal as a radiator.

In accordance with an aspect of the present invention, an antenna device of a portable terminal including conductive components is provided. The antenna device includes a first radiator connected to a power feeding unit of the portable terminal and a second radiator connected to each of the power feeding unit and a ground part of the portable terminal. At least one of the conductive components is connected to at least one of the first radiator and the second radiator.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
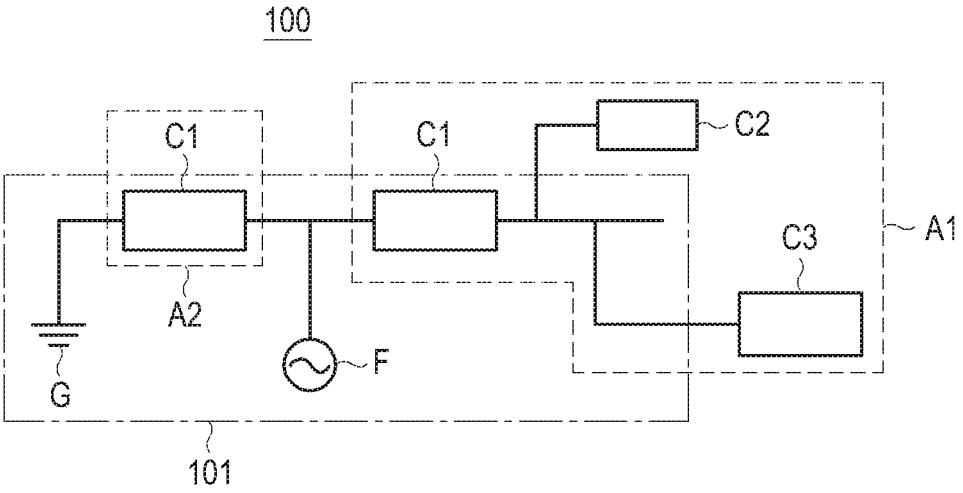
FIG. 1 is a view illustrating a configuration of an antenna device according to an exemplary embodiment of the present invention.
Figure 2:
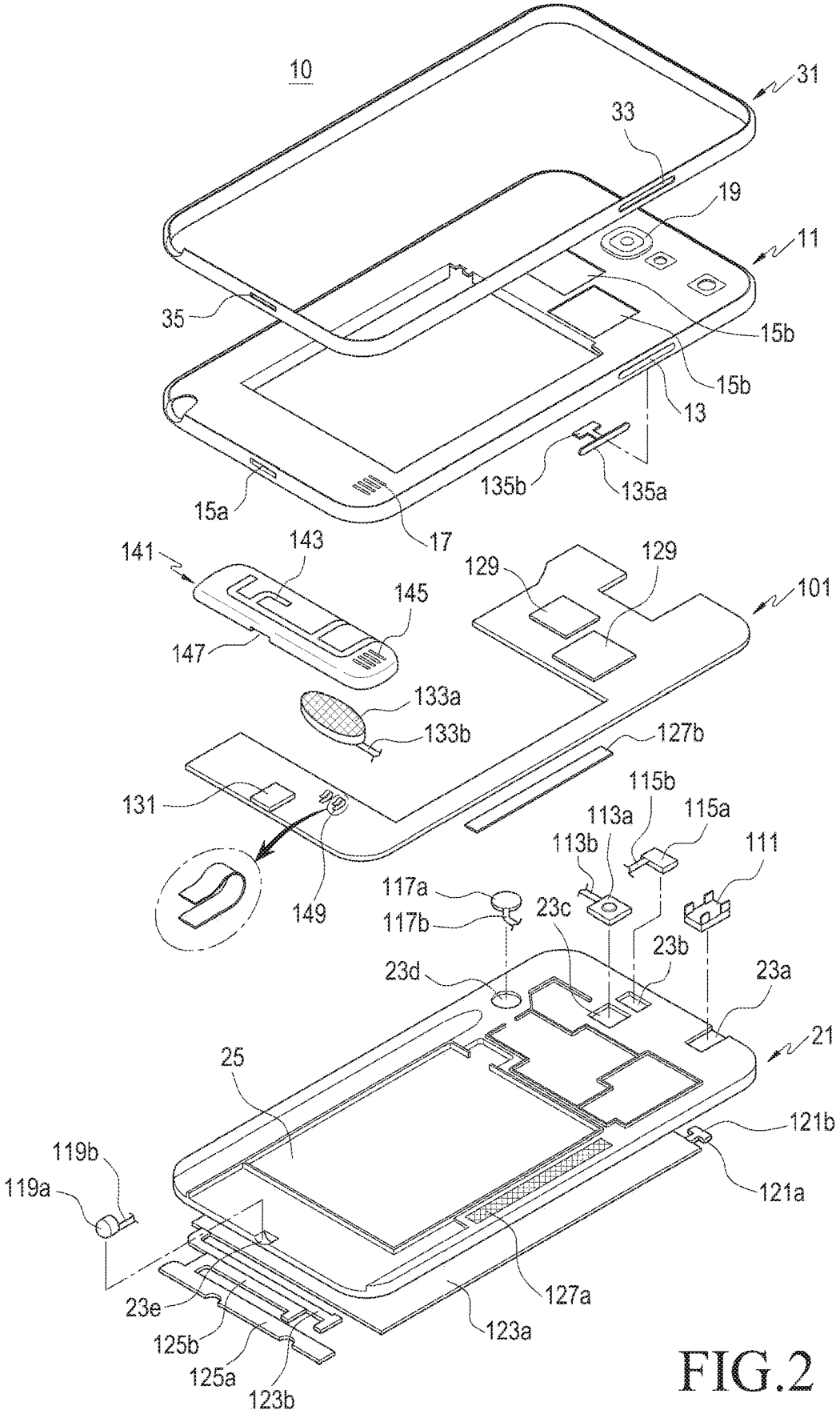
FIG. 2 is a view illustrating a portable terminal provided with the antenna device illustrated in FIG. 1 according to an exemplary embodiment of the present invention.

FIG. 1 is a view illustrating a configuration of an antenna device according to an exemplary embodiment of the present invention, and FIG. 2 is a view illustrating a portable terminal provided with the antenna device illustrated in FIG. 1 according to an exemplary embodiment of the present invention.

Referring to FIGS. 1 and 2, an antenna device 100 of a portable terminal 10 includes a first radiator A1 connected to a power feeding unit F, and a second radiator A2 connected to each of the power feeding unit F and a ground part G. Conductive components C1, C2 and C3 accommodated inside of the portable terminal 10 may be disposed on the first radiator A1 and the second radiator A2 or may be disposed separately from the first radiator A1 and the second radiator A2 and may be connected to any one of the first radiator A2 and the second radiator A2 through a predetermined route. Thus, the conductive components C1, C2 and C3 may also be used as radiators of the antenna device 100.

Although an inverted-F antenna structure is shown for the antenna device 100 disclosed in the present exemplary embodiment, the present invention is not limited thereto, and the antenna device may be configured as an antenna device having any other similar and/or suitable structure, such as a planar inverted-F antenna, a loop antenna, and a meander line antenna. Further, communication in an additional frequency band may be enabled using cables connected to the portable terminal 10 from the outside, for example, plugs or conducting wires of an earphone or a headset connected to an earphone-microphone socket.

The first radiator A1 is connected to the power feeding unit F, which is used as a main radiator and the second radiator A2 is connected to each of the power feeding unit F and the ground part G and is used as a sub-radiator. Typically, the first radiator A1 and the second radiator A2 are formed on a circuit board 101 of the portable terminal 10. However, according to other exemplary embodiments, radiation patterns may be formed on a structure separated from the circuit board 101 and connected to the power feeding unit F or the ground part G provided on the circuit board 101. Meanwhile, the conductive components C1, C2 and C3 may be mounted on the circuit board 101 or installed separately from the circuit board 101 and connected to the circuit board 101 through a flexible printed circuit board or the like. In addition, when either a metallic case 11 of the portable terminal 10 or a decorating material formed of a metallic material in the portable terminal 10 is a conductive material, they may be used as radiators of the antenna device 100 by being connected to the first radiator A1 or the second radiator A2.

Conductive components mounted on the circuit board 101, such as the conductive component C1, may include various connector members. For example, a Universal Serial Bus (USB) connector, a charge connector, an interface connector, an earphone-microphone socket, a storage medium socket, and any other similar and/or suitable connector member, may be directly mounted on the circuit board 101. Such connector members are provided with a plurality of terminals installed inside of the portable terminal 10 and enclosed by a housing of a metallic material in which the plurality of terminals ground the housing inside of the portable terminal 10. The antenna device 100 may use the connector members as radiators. That is, the connector members may be mounted on the first radiator A1 and the second radiator A2 or connected to one of the first radiator A1 and the second radiator A2 to be used as radiators.

The conductive components C2 and C3 are installed separately from the circuit board 101, and may include input/output devices, such as a microphone module 119*a*, a speaker module 133*a*, a vibration module 117*a*, a receiver module 115*a*, a proximity/illumination sensor module 121*a*, a camera module 113*a*, a keypad module 125*a*, 135*a*, and a display module 123*a*, various kinds of sensors, a flexible printed circuit board, or any other similar external devices and/or input/output devices. Here, the flexible printed circuit board may usually connect each of the modules listed above to the circuit board 101. The conductive component C2 may be at least partially connected to the first radiator A1 or the second radiator A2 when connected to the circuit board 101. Therefore, the conductive component C2 may be used as the radiators of the antenna device 100.

At this time, the flexible printed circuit board may include a conducting wire or conductive layer for providing a ground for the modules or for the flexible printed circuit board itself. In particular, the conducting wire or conductive layer for providing the ground may be used as a radiator in the configuration of the antenna device 100. That is, the conducting wire or the conductive layer, which provides a ground for the flexible printed circuit board when the modules are connected to circuit board 101 using the flexible printed circuit board, may be connected to the first radiator A1 or the second radiator A2 so that the flexible printed circuit board or at least one of the modules may be used as a radiator of the antenna device 100.

The conductive component C3 may include at least one of structural elements of the portable terminal 10 that are formed from metallic material, for example, a case 11, a bracket 21, a frame, a decoration member 31, screws or any other similar elements. The conductive component C3 may be used as a radiator since it is electrically conductive, although the conductive component C3 may not provide electric signal processing or input/output operations. Even if the case 11 or the bracket 21 is not formed from a metallic material, a conductive spray coating may be performed on the surfaces thereof to provide a ground. The frame is provided to reinforce the rigidity of the display module 123*a*, or any other part of the portable terminal 10, and may be made of a metallic material. The screws are provided to assemble and fasten the case 11, the circuit board 101, the bracket 21 and the like with one another in the portable terminal 10 and typically are made of a metallic material. Accordingly, the case 11, the bracket 21, the frame, and the screws may be connected to the first radiator A1 or the second radiator A2 to be used as the radiators of the antenna device 100.

Since the power feeding unit F and the ground part G are disposed on the circuit board 101, connectors for connecting the structural elements of the portable terminal 10 to the first radiator A1 or the second radiator A2 are needed, and a C-clip (not shown) or a double-sided tape 127*b* may be used as the connector. However, the present invention is not limited thereto, and the conductive components connected to the first radiator A1 or the second radiator A2 may have a connection structure using a capacitive coupling. In addition, some screws may be used to fasten the circuit board 101 to the bracket 21, in which case the screws may be disposed along a power feeding route or a ground route or may be disposed on the first radiator A1 or the second radiator A2 even if no separate connector is provided.

At this time, according to an exemplary embodiment of the present invention, a conductive component connected to the first radiator A1 or the second radiator A2 may be serially connected between the power feeding unit F and the first radiator A1, between the power feeding unit F and the second radiator A2, or between the ground part G and the second radiator A2. That is, according to the present exemplary embodiment, in the antenna device 100, a conductive component accommodated inside of the portable terminal 10 or a conductive component forming the external appearance of the portable terminal 10 may be arranged to form a branch structure with the first radiator A1 and the second radiator A2 or to form a part of the first radiator A1 and the second radiator A2.

Meanwhile, the antenna device 100 may further include a radiation pattern according to a frequency band or may include the radiation pattern in order to adjust a radiation characteristic or in order to perform similar functions. For example, when an additional radiation pattern is connected to the first radiator A1 or the second radiator A2, the antenna device 100 may secure an operation characteristic in multiple bands.

Hereinafter, the portable terminal 10 provided with the antenna device 100 will be described in further detail with reference to FIG. 2.

Referring to FIG. 2, the portable terminal 10 accommodates the circuit board 101 between the case 11 and the bracket 21, and the display module 123*a* is mounted on a front surface of the bracket 21. In addition, a window member (not illustrated) is mounted on the front surface of the bracket 21, in which the window member protects the display module 123*a*. Further, a touch screen (not shown) is disposed on the window member so that the terminal 10 is provided with a touch screen display device. Also, the case 11 may be made of a metallic material, and when the case 11 is fabricated by injection molding a synthetic resin, a reinforcement member of a metallic material or the decoration member 31 may be provided. The decoration member 31 may be provided in a frame form made of a metal or plated with a metal, or may be made of any similar and/or suitable material, and configured to be engaged with the periphery of the case 11.

Although the case 11 may be made of a synthetic material, the case 11 may be made of a metallic material. In addition, the rigidity of the case 11 may be increased by partially using a metallic material. The case 11 may be provided with openings 15*a*, 15*b* and 19 so as to expose the connector members or modules mounted on the circuit board 101 or the bracket 21. For example, connector members, such as an interface connector 131 or storage medium sockets 129, may be disposed on the circuit board 101 so that the case 11 exposes the connector members through some of the openings 15*a* and 15*b*. In addition, the case 11 may include a key hole 13 formed on a side surface, and a speaker hole 17 formed on the rear surface, in which the keypad module 135*a*, used for adjusting volume or the like, is disposed through the key hole 13. When there is a speaker device 133*a* provided separately from the receiver module 115*a*, a sound may be output through the speaker hole 17. The decoration member 31 engaged with the periphery of the case 11 may be provided with holes 33 and 35 corresponding to the key hole 13 or the opening 15*a*.

The bracket 21 provides a battery mounting surface 25 and includes recesses 23*a*, 23*b*, 23*c*, 23*d* and 23*e* for mounting an earphone-microphone socket 111, the camera module 113*a*, the microphone module 119*a*, the speaker module 133*a*, the vibration module 117*a*, the receiver module 115*a*, the proximity/illumination sensor module 121*a*, the keypad module 125*a*, 135*a*, the display module 123*a*, and other similar modules and/or elements included in the portable terminal 10, around the periphery of the battery mounting surface 25 or on the front surface thereof. However, some modules, for example, the speaker module 133*a*, the keypad module 125*a*, and the display module 123*a* may be attached to the circuit board 101 or the front surface of the bracket 21. In addition, the bracket 21 may provide a ground region 127*a* which has a spray coated conductive layer.

The ground region 127*a* may be formed on the entire surface of the bracket 21 or may be formed only at some portions of the surface of the bracket 21. When assembling the bracket 21 and the circuit board 101 to be opposed to each other, fastening members, such as screws, may be used for stable position fixing. When the ground region 127*a* formed on the bracket 21 is electrically connected to the circuit board 101, the bracket 21 may be grounded and electrically stabilized. At this time, the double-sided tape 127*b*, which may be conductive and may also be referred to as a conductive double-sided tape 127*b*, may be used when connecting the ground region 127*a* to the circuit board 101.

The above-mentioned modules may include respective flexible printed circuit boards 113*b*, 115*b*, 117*b*, 119*b*, 121*b*, 123*b*, 125*b*, 133*b*, and 135*b* or respective conducing wires, and each of the flexible printed circuit boards or conducting wires is connected to the circuit board 101.

Meanwhile, even if the portable terminal 10 includes the touch screen display device, some physical keys, such as a power key, or any other similar and/or suitable key may be included in the portable terminal 10. Accordingly, another keypad module that produces an input signal when the user operates a key may be included in the portable terminal 10. The portable terminal 10 may include the keypad module 135*a* corresponding to the key arranged on the side surface of the case 11 and the keypad module 125*a* disposed at a side of the display module 123*a*.

As described above, the bracket 21 is coupled to the case 11 to configure the housing of the terminal 10 and the circuit board 101 is installed between the bracket 21 and the case 11. Most of the modules installed on the bracket 21 are protected by the case 11, and the camera module 113*a* is provided with a photographing route through the opening 19. In addition, the display module 123*a* and the proximity/illumination sensor 121*a* are disposed in the terminal 10, and, more specifically, are disposed on the front surface of the bracket 21 and are protected by the window member as described above.

The connector members, the input/output devices, various kinds of sensors, and structural elements formed of a conductive material, as described above, are directly connected to the power feeding unit F or the ground part G or are connected to the first radiator A1 or the second radiator A2, thereby forming radiators of the antenna device 100.

Meanwhile, as described above, the antenna device 100 may further include a separate radiation pattern 143. The separate radiation pattern 143 is installed at a position spaced apart from the circuit board 101, and the portable terminal 10 is provided with a carrier 141 so as to keep the separate radiation pattern 143 spaced apart from the circuit board 101. The carrier 141 has a predetermined volume within a range allowed by the bracket 21 and the case 11, and is disposed on the circuit board 101. When a connector member or the like is disposed between the carrier 141 and the circuit board 101, the carrier 141 should be provided with a recess 147 for accommodating the connector member or the like.

The separate radiation pattern 143 is disposed on the outer peripheral surface of the carrier 141, and may be connected to the first radiator A1 or the second radiator A2 through a connection member 149 disposed on the circuit board 101. The connection member 149 may be any suitable element for connecting the carrier 141 to the first radiator A1 or the second radiator A2, such as a C-clip. In addition, even if the connection member 149 is not installed, the separate radiation pattern 143 may be connected to the first radiator A1 or the second radiator A2 through a conductive component, for example, through the interface connector 131. That is, when a part of the separate radiation pattern 143 is fabricated in a shape of the C-clip in the inside of the carrier 141, then the separate radiation pattern 143 may be connected to the first radiator A1 or the second radiator A2 through a conductive component, such as the interface connector 131.

As described above, the speaker module 133*a* may be provided separately from the receiver module 115*a*. In the present exemplary embodiment, the speaker module 133*a* may be accommodated inside of the carrier 141 and may use the inner space of the carrier 141 as a resonance space. The carrier 141 may be provided with at least one emitting hole 145 for emitting a sound generated by the speaker module 133*a*. The speaker module 133*a* may also be directly connected to the circuit board 101 via an additional connection member, and in the present exemplary embodiment, the flexible printed circuit board 133*b* extends from the speaker module 133*a*. That is, the speaker module 133*a* is connected to the circuit board 101 through the flexible printed circuit board 133*b*.

The circuit board 101 includes circuit devices for controlling overall functions of the portable terminal 10, and the circuit devices may be a processor, a transmission/reception circuit, or any other similar and/or suitable circuit device for controlling the portable terminal 10, and some conductive components are directly mounted on the circuit board 101. Conductive components which are made of a conductive material but which are not directly used for the operations of the circuit devices are connected to a ground layer provided on the circuit board 101 within an electronic device, such as the portable terminal 10. For example, a connector member may be grounded to a metallic material portion, such as a terminal, other than terminals for transmitting a signal. Accordingly, when the housing of a connector member is made of a metallic material, the housing is connected to the ground layer of the circuit board 101. In addition, the modules which are not installed on the circuit board 101 may also be connected to the ground layer of the circuit board 101 or a ground layer provided at a proper position within the portable terminal 10 through flexible printed circuit boards or the like.

Figure 3:
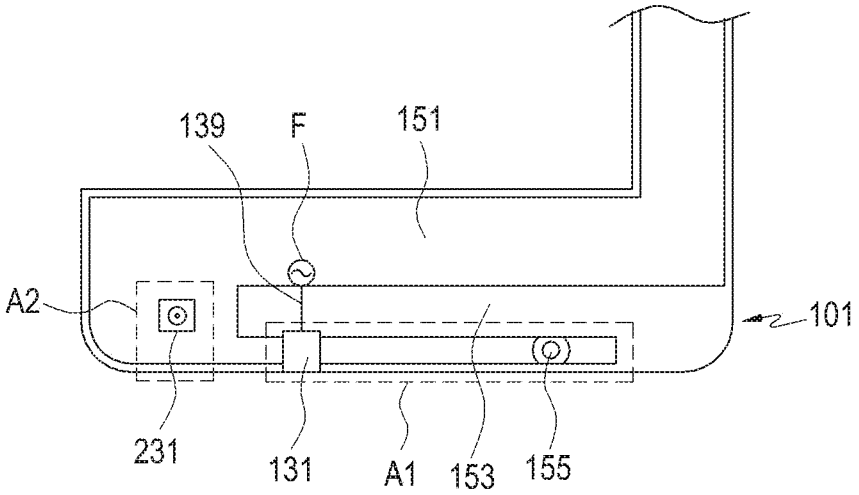
FIG. 3 is a view illustrating portions of the antenna device provided in the portable terminal illustrated in FIG. 2 according to an exemplary embodiment of the present invention.

FIG. 3 is a view illustrating portions of the antenna device provided in the portable terminal illustrated in FIG. 2 according to an exemplary embodiment of the present invention.

Referring to FIG. 3, a configuration in which conductive components directly mounted on the circuit board 101 is shown, and more specifically, the present exemplary embodiment includes the conductive components directly mounted on connector members that are used as some of the radiators of the antenna device 100. However, as described above, input/output devices, various kinds of sensors, flexible printed circuit boards, and structural elements including the bracket 21 may also be used as some of the radiators of the antenna device 100.

The circuit board 101 is provided with a conductive layer 151 which is formed generally over the entire area of the circuit board 101. The conductive layer 151 is provided as a ground layer on the circuit board 101. However, the conductive layer 151 is configured to provide a ground in relation to integrated circuit chips or connector members disposed on the circuit board 101 and a part of the conductive layer 151 is also used as a radiator of the antenna device 100 according to an exemplary embodiment of the present invention.

The antenna device 100 includes a slit 153 formed by removing a part of the conductive layer 151. The slit 153 is formed to extend across a part of the conductive layer 151, and a part of the conductive layer 151 positioned at an edge side of the circuit board 101 is used as a radiator of the antenna device 100. At this time, one of the connector members, for example, the interface connector 131, as illustrated in FIG. 3, is mounted on the conductive layer 151 at an edge of the circuit board 101. Accordingly, the interface connector 131 is grounded to the conductive layer 151 provided on the circuit board 101. The interface connector 131 connects the portable terminal 10 to a personal computer or any other similar and/or suitable external device, and may also be used as a charge connector, or a USB connector.

In addition, the power feeding unit F is provided on the circuit board 101, and is connected to the interface connector 131 through a power feeding line 139 formed across the slit 153. That is, the interface connector 131 is grounded to the conductive layer 151 and, at the same time, connected to the power feeding unit F through the power feeding line 139. A part of the conductive layer 151 extending to the right from the interface connector 131 forms the first radiator A1 of the antenna device 100. A screw hole 155 may be formed in the circuit board 101 to fasten a screw for fastening the circuit board 101 to the bracket 21, in which the screw hole 155 may be positioned on the first radiator A1. Accordingly, the screw fastened through the screw hole 155 may also be connected to the first radiator A1.

In the exemplary embodiment of FIG. 3, a part of the conductive layer 151 positioned at the left side of the interface connector 131 forms the second radiator A2. That is, both the first radiator A1 and the second radiator A2 are substantially formed around the slit 153. Another connector member, for example, a test connector 231 for measuring the radiation characteristic of the antenna device 100, may be disposed on the second radiator A2. The connector member disposed on the second radiator A2 is also substantially connected to the second radiator A2 and is used as a part of the second radiator A2. As described above, although the conductive layer 151 is configured to provide a ground of the circuit board 101, a part of the conductive layer 151 may also be used as the first radiator A1 and the second radiator A2 of the antenna device 100 through the arrangement of the slit 153 and the power feeding line 139, as illustrated in FIG. 3. Meanwhile, although the power feeding line 139 is shown in a form of straight line form, it may be configured in a form of a curved line, a zigzag line, or any other similar and/or suitable line form so as to set the electrical length of the first radiator A1.

Figure 4:
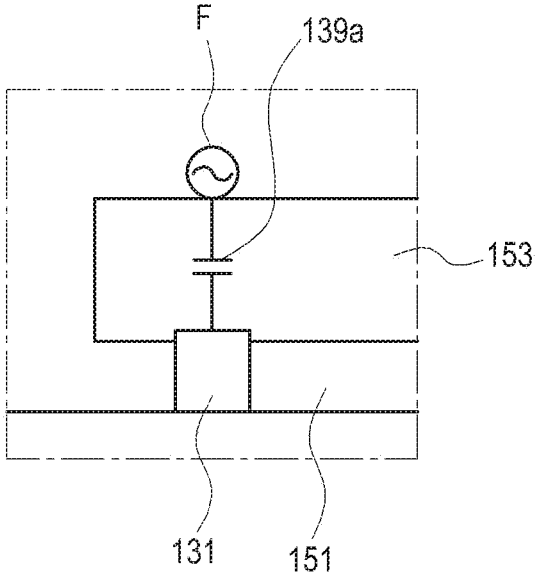
FIGS. 4 and 5 are views illustrating the antenna device illustrated in FIG. 3 according to exemplary embodiments of the present invention.
Figure 5:
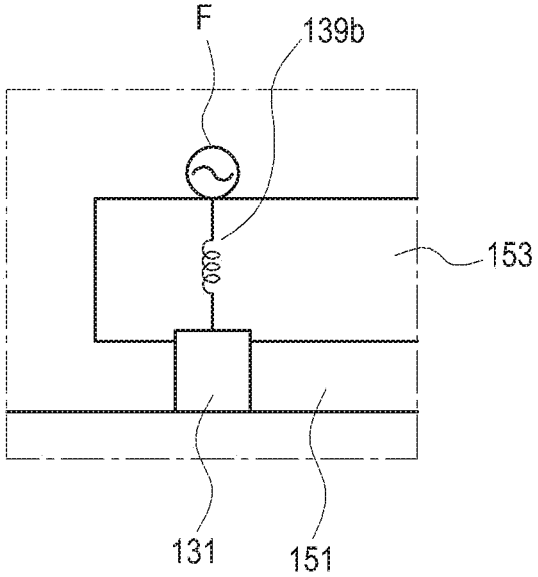

FIGS. 4 and 5 are views illustrating the antenna device illustrated in FIG. 3 according to exemplary embodiments of the present invention.

Referring to FIGS. 4 and 5, the power feeding line 139 may be configured using a capacitive coupling element 139*a*, as shown in FIG. 4, or an inductive coupling element 139*b*, as shown in FIG. 5. The configuration of the power feeding line 139 according to the exemplary embodiments of FIGS. 4 and 5 allows for an operating frequency and/or a bandwidth of the antenna device 100 to be adjusted. More various configurations for adjusting the operating frequency and/or the bandwidth of the antenna device 100 are illustrated in FIGS. 9 to 15, and will be described below.

Figure 6:
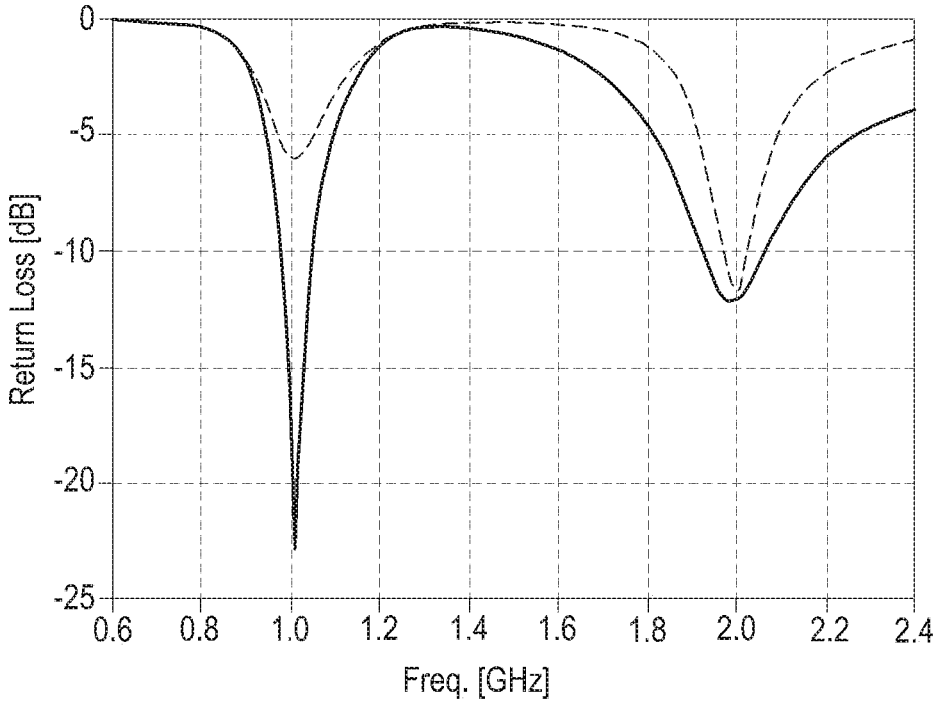
FIG. 6 is a graph for describing a radiation characteristic of the antenna device illustrated in FIG. 3 according to an exemplary embodiment of the present invention.

FIG. 6 is a graph for describing a radiation characteristic of the antenna device illustrated in FIG. 3 according to an exemplary embodiment of the present invention.

Referring to FIG. 6, the graph illustrates the radiation characteristic of the antenna device 100 illustrated in FIG. 3 according to frequency, and in particular, illustrates a reflection loss in comparison to the radiation characteristic of a related art embedded antenna device of a portable terminal to the antenna device 100 according to an exemplary embodiment of the present invention. In the graph illustrated in FIG. 6, the dotted line indicates the reflection loss of the related art embedded antenna device and the solid line indicates the reflection loss of the antenna device 100. As shown in FIG. 6, it will be appreciated that the related art embedded antenna device secures a resonance characteristic at frequency bands of about 1 GHz and 2 GHz. In configuring such the related art embedded antenna device, when conductive components, such as a connector member of a radiator as described above, accommodated in a portable terminal, it will be appreciated that a substantial improvement may be obtained in connection with the reflection loss or the bandwidth. More specifically, it will be appreciated that at the resonance band of 1 GHz, the reflection loss is improved by about 15 dB, and a substantial improvement in reflection loss may be obtained at the resonance band of 2 GHz although the improvement is low as compared to that at the band of 1 GHz.

Furthermore, when configuring the related art embedded antenna device, a radiator should be installed at an independent location so that other conductive components are not electrically interfering with each other. Thus, there is a substantial limit in connection with the installation position. Whereas, since the antenna device of the present exemplary embodiments described above uses conductive components, such as a connector member accommodated in a portable terminal, as a part of a radiator, the performance of the antenna device and the degree of freedom of design in position setting or the like may be improved.

Figure 7:
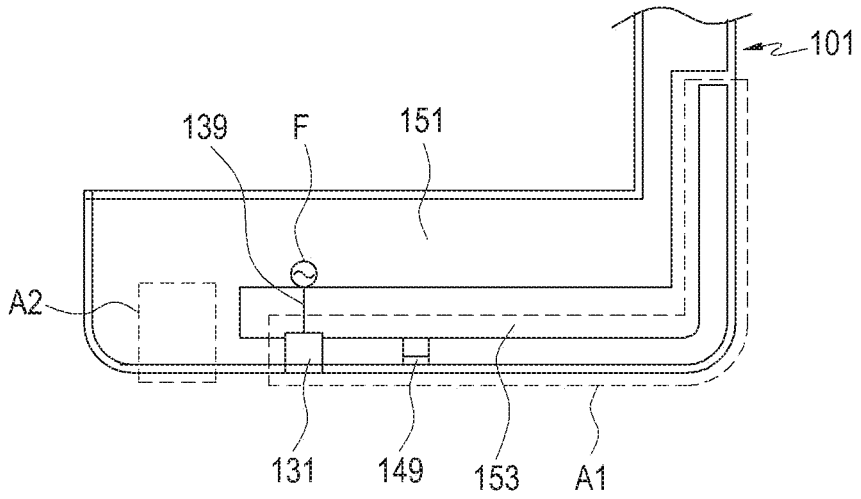
FIGS. 7 and 8 are views illustrating the antenna device illustrated in FIG. 3 according to exemplary embodiments of the present invention.
Figure 8:
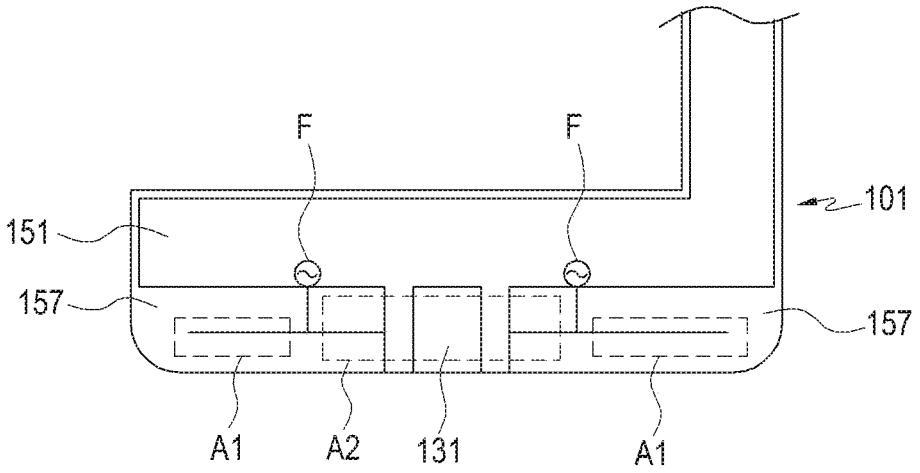

FIGS. 7 and 8 are views illustrating the antenna device illustrated in FIG. 3 according to exemplary embodiments of the present invention.

Referring to FIG. 7, a configuration for connecting the case 11, the decoration member 31, the bracket 21 or the like, which are formed of a metallic material, to the first radiator A1 as an exemplary embodiment of the antenna device illustrated in FIG. 3 is shown. In an exemplary embodiment where at least one of the case 11, the decoration member 31, and the bracket 21 are made of a synthetic resin material, they may be used as the radiators of the antenna device 100 by connecting the ground region 127*a* formed on the surface of the case 11 or the bracket 21 to the first radiator A1 or the second radiator A2.

In order to connect at least one of the case 11, the decoration member 31, and the bracket 21 to the first radiator A1 or the second radiator A2, the antenna device 100 is provided with the connection member 149. In the exemplary embodiment of FIG. 2, the connection member 149 connects the radiation pattern 143, which is formed on the carrier 141, to the first radiator A1 or the second radiator A2, and the connection member 149 may connect at least one of the case 11, the decoration member 31, and the bracket 21 to the first radiator A1 or the second radiator A2 according to the disposed position thereof. In addition, when a screw or the like is independently fastened to the circuit board 101 within the portable terminal 10, at least one of the case 11, the decoration member 31, and the bracket 21 may be connected to the first radiator A1 or the second radiator A2 through the connection member 149.

When the bracket 21 is formed of a conductive material and configured to be partly exposed to the outside of the portable terminal 10, the bracket 21 may be used as a radiator of the antenna device 100 and also may be used as another decoration member in addition to the decoration member 31. When the bracket 21 is partially exposed to the outside of the portable terminal 10, it may be positioned between the window member and the metallic case 11. Accordingly, the bracket 21 may be used for decoration purposes by providing metallic gloss along the peripheral rim of the window member, and the antenna device 100 allows a radiator to be disposed on a surface of the terminal 10 although it is configured as an embedded structure.

Connecting of the bracket 21 to the circuit board 101, and more specifically, connecting of the bracket 21 to the first radiator A1 or the second radiator A2 may be done via the connection member 149 and also via the conductive double-sided tape 127*b*. The conductive double-sided tape 127*b* may configured to connect at least one of the bracket 21 or the ground region 127*a*, which is formed in the bracket 21, to the ground layer of the circuit board 101 as well as to stably fix the circuit board 101 to the bracket 21.

Like the antenna device 100 of the exemplary embodiment of FIG. 3, the antenna device 100 of the exemplary embodiment of FIG. 7 is also configured such that the power feeding line 139 is connected to the interface connector 131 and the interface connector 131 and the conductive layer 151 extending to the right side of the interface connector 131 forms the first radiator A1 of the antenna device 100. In addition, in the exemplary embodiment of FIG. 7, a part of the conductive layer 151 positioned at the right side of the interface connector 131 is formed as the second radiator A2 of the antenna device 100.

Referring to FIG. 8, the antenna device 100, is a modification of the exemplary embodiment of FIG. 3, wherein the conductive layer 151 is removed from the both sides of the region where the interface connector 131 is mounted to form fill-cut regions 157, each of which is provided with a radiation pattern and a power feeding unit F according to the present exemplary embodiment of FIG. 8. In the present exemplary embodiment, a part of each of the radiation patterns forms the second radiator A2 together with the interface connector 131, and the remaining portions of the radiation patterns form a plurality of first radiators A1, which are disposed so as to be independent from each other at the opposite sides of the second radiator A2. Also in the present exemplary embodiment of FIG. 8, the first radiator A1 or second radiator A2 may be connected to at least one of the bracket 21, the case 11 or the radiation pattern 143 formed on the carrier 141 through the connection member 149 or the double-sided tape 127*b*.

FIGS. 9 to 15 are views illustrating configurations for improving a radiation performance of the antenna device illustrated in FIG. 1 according to exemplary embodiments of the present invention.

Referring to FIGS. 9 to 15, configurations for adjusting or improving the radiation characteristic of the antenna device 100 according to exemplary embodiments of the present invention, are illustrated. Although configurations that use an active element, such as a switch element or a matching element, are illustrated in FIGS. 9 to 15 and are described below, the present invention is not limited thereto, and the radiation characteristic of the antenna device 100 may be adjusted using a passive element such as a diplexer or a duplexer.

Figure 9:
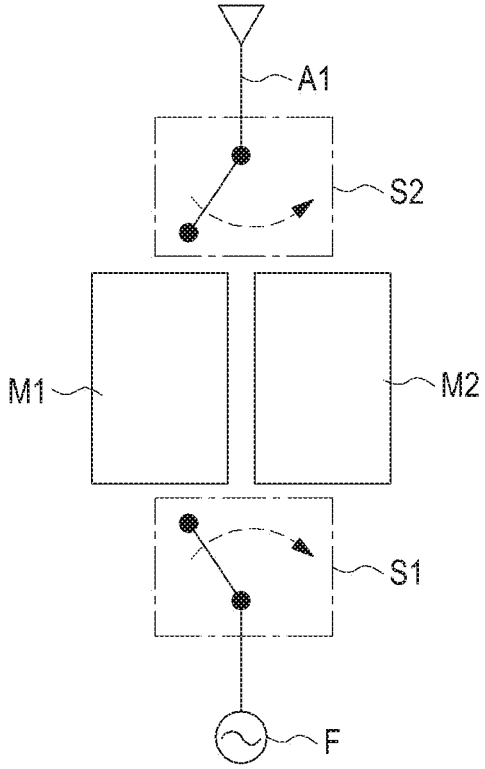
FIGS. 9 to 15 are views illustrating configurations for improving a radiation performance of the antenna device illustrated in FIG. 1 according to exemplary embodiments of the present invention.
Figure 10:
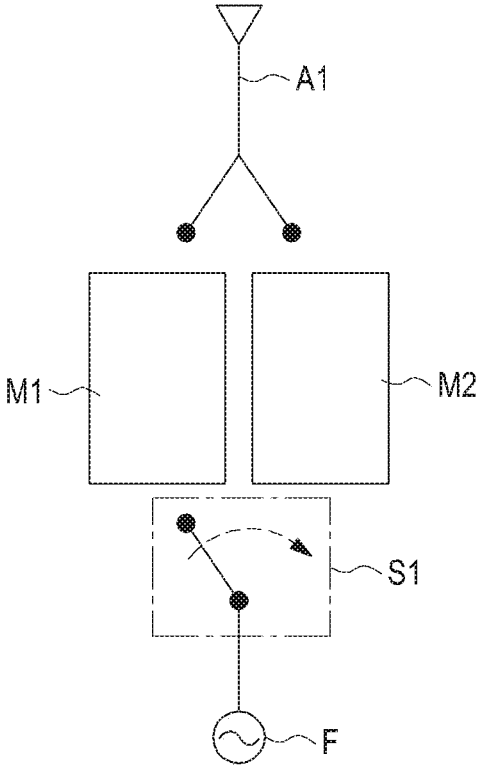

The exemplary embodiments of FIGS. 9 and 10 illustrate configurations in which a pair of matching elements M1 and M2 are disposed and switch elements S1 and S2 are serially arranged in relation to the matching elements M1 and M2. In the exemplary embodiment of FIG. 9, one of the matching elements M1 and M2 may be connected to one of the first radiator A1 and the power feeding unit F according to the switching elements S1 and S2. In the exemplary embodiment of FIG. 10, both of the matching elements M1 and M2 are connected to the first radiator A1 at the same time, and one of the matching elements M1 and M2 are connected to the power feeding unit F according to the switching element S1. Additionally, the switch elements S1 and S2 or the matching elements M1 and M2 may be used to connect the second radiator A2 and the power feeding unit F. Here, since a conductive component is connected to the first radiator A1 or the second radiator A2, the switch elements S1 and S2 or the matching elements M1 and M2 are provided between the conductive component and the power feeding unit F or between the conductive component and the ground part G. The switch elements S1 and S2 may be provided between the matching elements M1 and M2 and the first radiator A1, between the matching elements M1 and M2 and the power feeding unit F, or at one of these positions.

Figure 11:
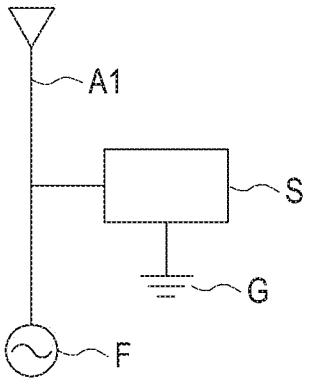
Figure 12:
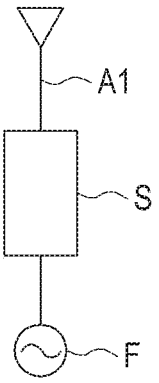

Referring to FIG. 11, a switch element S is disposed between the first radiator A1 and the ground part G so as to be on the second radiator A2, according to an exemplary embodiment of the present invention. Referring to FIG. 12, the first radiator A1 and the switch element S are serially disposed according to an exemplary embodiment of the present invention. When a capacitive element or an inductive element is disposed together with the switch element S, or a variable capacitive element or a variable inductive element is disposed instead of the switch element S, then the resonance frequency band of the antenna device 100 may be adjusted. That is, the resonance frequency of the antenna device 100 may be selected according to the operation of the switch element S.

Figure 13:
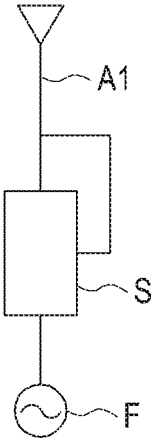
Figure 14:
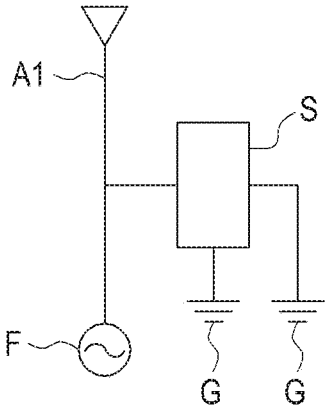

Referring to FIG. 13, a switch element S is disposed such that power feeding lines of different routes may be selected between the first radiator A1 and the power feeding unit F according to an exemplary embodiment of the present invention. Referring to FIG. 14, a switch element S is disposed such that electrical routes between the first radiator A1 and the ground part G, which are the electrical routes formed by the second radiator A2, may be selected according to an exemplary embodiment of the present invention. Since the electrical routes, which are connected to the power feeding unit F or the ground part G according to the operation of the switch element S, become different from each other and thus, the electrical length of the antenna device 100 is varied, the resonance frequency characteristic may be adjusted.

Figure 15:
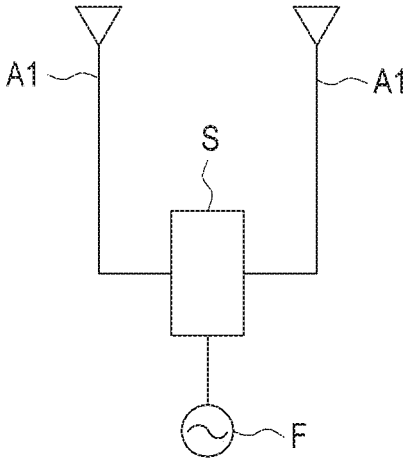

Referring to FIG. 15, a plurality of first radiators A1 are disposed such that the first radiators A1 are independent from each other and such that one of the first radiators A1 may be selected by the switch element S to be connected to the power feeding unit F according to an exemplary embodiment of the present invention. At this time, the first radiators A1 may operate at different frequency bands.

According to an exemplary embodiment, an additional slit (not shown), which is in addition to the slit 153, may be formed by removing a part of the conductive layer 151 around the first radiator A1 or the second radiator A2 or around the connector members connected to the first radiator A1 or the second radiator A2 in order to adjust the radiation characteristic of the antenna device 100. When forming the additional slit around the connector members or around the first radiator A1 and the second radiator A2, an amount and a flow direction of a current around the radiators of the antenna device 100 may be controlled by setting a width and a length of the additional slit. Accordingly, an impedance of the antenna device 100 around conductive components or around the first radiator A1 and the second radiator A2 may be adjusted using the additional slit, and the bandwidth or efficiency of the antenna device 100 may be improved.

An antenna device according to the exemplary embodiments described above uses conductive components accommodated in a portable terminal as a radiator, and the antenna device may be installed in the inner space of a miniaturized and lightened portable terminal. Also, a stable radiation function may be provided by connecting a radiation pattern to a conductive component or using a matching circuit. In addition, as the antenna device is installed inside of the portable terminal together with the conductive components, the antenna device may have a stable radiation efficiency and a bandwidth increase may be obtained while using the inner space of the portable terminal efficiently as compared to a related art embedded antenna device which is electrically isolated. Further, since the conductive components within the portable terminal are used as a radiator, the degree of freedom of design of the antenna in the inner space of the portable terminal may be improved.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A portable communication device comprising:

a circuit board including a conductive layer and a feeding line, the conductive layer is formed on the circuit board such that a slit is located between a first portion of the conductive layer and a second portion of the conductive layer, the feeding line is located across the slit to connect the first and second portions, the first portion of the conductive layer at least partially forms a ground portion of the portable communication device; and a conductive component at least partially mounted on the second portion of the conductive layer and directly connected to the feeding line, wherein the conductive component is adapted to radiate using a power supplied via the feeding line.

2. The portable communication device of claim 1, wherein a first end of the feeding line is connected to the first portion of the conductive layer, and a second end of the feeding line is connected to the second portion of the conductive layer.

3. The portable communication device of claim 1, further comprising another conductive component at least partially mounted on a third portion of the conductive layer and adapted to radiate using the power.

4. The portable communication device of claim 3, wherein the feeding line is electrically connected to the conductive component and the other conductive component.

5. The portable communication device of claim 3, wherein the other conductive component is electrically connected to the ground portion of the portable communication device.

6. The portable communication device of claim 3, wherein the other conductive component includes a connector to electrically connect the conductive component to an external device such that the external device is to measure a characteristic corresponding to the radiating of the conductive component.

7. The portable communication device of claim 1, wherein the conductive component comprises a universal serial bus connector, a charge connector, an interface connector, an earphone-microphone socket, a storage medium socket, or any combination thereof.

8. The portable communication device of claim 1, further comprising a third conductive component at least partially mounted on the second portion of the conductive layer, the third conductive component electrically connected to the second portion of the conductive layer.

9. The portable communication device of claim 8, wherein the third conductive component comprises a C-clip, a double-sided tape, a screw, or any combination thereof.

10. The portable communication device of claim 8, further comprising an antenna being separated from the conductive component, wherein the third conductive component forming at least part of a radiating portion of the antenna.

11. The portable communication device of claim 8, further comprising a cover forming at least part of an outer surface of the portable communication device, wherein the third conductive component is electrically connected to at least part of the cover.

12. The portable communication device of claim 1, wherein at least part of the second portion of the conductive layer is adapted to radiate using the power.

13. The portable communication device of claim 11, wherein the third conductive component comprises a bracket, a frame, a decoration member, or any combination thereof.

14. The portable communication device of claim 11, wherein the cover is substantially planar.

15. A portable communication device comprising:

a circuit board including a conductive layer and a feeding line, the conductive layer is formed on the circuit board such that a slit is located between a first portion of the conductive layer and a second portion of the conductive layer, the feeding line is located across the slit to connect the first and second portions, the first portion of the conductive layer at least partially forming forms a ground portion of the portable communication device, the second portion of the conductive layer at least partially forms a radiating portion of the portable communication device and adapted to radiate using a power supplied via the feeding line; and a conductive component at least partially mounted on the second portion of the conductive layer, and directly and electrically connected to the feeding line.

16. The portable communication device of claim 15, wherein the conductive component is adapted to form at least one subportion of the radiating portion of the portable communication device.

17. The portable communication device of claim 15, further comprising a second conductive component at least partially mounted on a third portion of the conductive layer and electrically connected to the feeding line and adapted to radiate using the power supplied via the feeding line.

18. The portable communication device of claim 17, wherein the second conductive component is electrically connected to the ground portion of the portable communication device.

19. A portable communication device comprising:

a case forming at least part of an outer surface of the portable communication device;

a circuit board at least partially accommodated by the case, the circuit board including a conductive layer and a feeding line, the conductive layer is formed on the circuit board such that a slit is located between a first portion of the conductive layer and a second portion of the conductive layer, the feeding line is located across the slit to connect the first and second portions, the first portion of the conductive layer at least partially forms a ground portion of the portable communication device, at least part of the second portion of the conductive layer is adapted to radiate using a power supplied via the feeding line; and a conductive component electrically connected to the case, at least partially mounted on the second portion of the conductive layer, directly and electrically connected to the feeding line, and adapted to radiate using the power supplied via the feeding line.

20. The portable communication device of claim 19, further comprising a coupling element electrically connected to the conductive component or the at least part of the second portion such that a characteristic with respect to the radiating of the conductive component or the at least part of the second portion is to be adjusted using the coupling element.

* * * * *